United States Patent [19]

Brandstätter et al.

[11] 3,969,981

[45] July 20, 1976

[54] MACHINE GUN CARTRIDGE MAGAZINE

[75] Inventors: Hubertus Brandstätter; Oswald Tschöll, both of Kufstein, Austria

[73] Assignee: American International Corporation, Salt Lake City, Utah

[22] Filed: Apr. 12, 1974

[21] Appl. No.: 460,602

[52] U.S. Cl. ..... 89/33 D

[51] Int. Cl.[2] ..... F41C 25/10

[58] Field of Search ..... 89/33 D

[56] References Cited

UNITED STATES PATENTS

| | | | |
|---|---|---|---|
| 1,293,396 | 2/1919 | Fox | 89/33 D |
| 1,337,893 | 4/1920 | Farquhar et al. | 89/33 D |
| 3,319,523 | 5/1967 | Casull | 89/33 D |

FOREIGN PATENTS OR APPLICATIONS

| | | | |
|---|---|---|---|
| 317,580 | 12/1919 | Germany | 89/33 D |
| 330,527 | 12/1920 | Germany | 89/33 D |

*Primary Examiner*—Stephen C. Bentley
*Attorney, Agent, or Firm*—Emory L. Groff, Jr.

[57] ABSTRACT

A drum type cartridge magazine includes a ring-shaped cartridge cover slidably mounted above a base plate having a cartridge exit. A drive assembly is removably attachable to the base plate within the cover and is provided with a wind-up plate which is manipulated to tighten a spring contained therein and which serves to rotate the cover as cartridges are received from the exit. Unique means are provided to automatically limit winding of the spring element and to permit removal of the drive assembly from the balance of the magazine whether or not the spring is under tension.

22 Claims, 12 Drawing Figures

MACHINE GUN CARTRIDGE MAGAZINE

This invention relates generally to guns of the automatic firing type, and more particularly, to an improved cartridge magazine for machine guns.

Many prior efforts at providing cartridge magazines for machine guns have met with mixed results. In attempts to provide a relatively high bullet capacity, the weight of some loaded magazines presented an assembly which at best was unwieldy. Certain other mechanisms have included bullet guiding and feeding structure of such intricate design that either the cost of producing same was prohibitive or the reliability of its operation questionable. Additionally, shortcomings have been found in various earlier spring windup or driving mechanisms.

An example of a prior known mechanism will be found in U.S. Pat. No. 3,319,523, issued May 16, 1967, and which discloses a cartridge feeding mechanism wherein the bullets are disposed in individual interconnected layers as formed by a plurality of decks within the magazine. Additional means separates each bullet horizontally such that when the outer housing of the magazine was rotated all bullets in the magazine were simultaneously advanced horizontally within each deck and also urged downwardly sequentially from the uppermost deck to the next lowest deck as each bullet was forced from the exit of the lowermost deck into the gun chamber. The present invention offers a significantly improved structure eliminating any vertical separating means between a plurality of stacked cartridges in a drum magazine. The cartridges are merely separated laterally and are constantly spring-urged downwardly such that upon rotation of the magazine, feeding means at the bottom of the magazine sequentially strips the lowestmost cartridge from each vertical column of cartridges and directs same into a feed block in the receiver of the gun.

An additional feature in the improved instant magazine comprises a spring drive mechanism containing brake means which may be actuated at any time regardless of the condition of the spring therein in order to permit removal of the spring driving mechanism from the remainder of the magazine in a perfectly safe manner without the necessity of relieving the tension of the spring therein. Additional structure is included allowing removal of the entire cartridge magazine from the gun regardless of the condition of the spring driving mechanism without any concern for the possible ejection of cartridges from the magazine or unwanted actuation of the spring drive assembly.

To enhance uniformity in the operating force as delivered by the spring assembly and to preclude excessive winding of the spring means therein, an improved arrangement is included, serving as an overwind preventer.

Accordingly, one of the objects of the present invention is to provide an improved cartridge magazine for machine guns including a relatively lightweight construction wherein the entire magazine may be removed from the gun without the possibility of the spring driving mechanism therein causing ejection of cartridges therefrom.

Another object of the present invention is to provide an improved machine gun cartridge magazine containing a spring drive assembly which may be separately removed from the remainder of the magazine regardless of the condition of the spring means therein.

Still another object of the present invention is to provide an improved machine gun cartridge magazine containing a separately removable spring drive assembly having a selectively operable brake, the actuation of which immobilizes the drive assembly with respect to the balance of the magazine.

Another object of the present invention is to provide an improved machine gun cartridge magazine containing a spring drive assembly adapted to be manually rotated to actuate spring means therein and including overwind prevention means.

With these and other objects in view, which will more readily appear as the nature of the invention is better understood, the invention consists in the novel construction, combination and arrangement of parts hereinafter more fully described, illustrated and claimed.

Similar reference characters designate corresponding parts throughout the several figures of the drawings.

Figure 1:
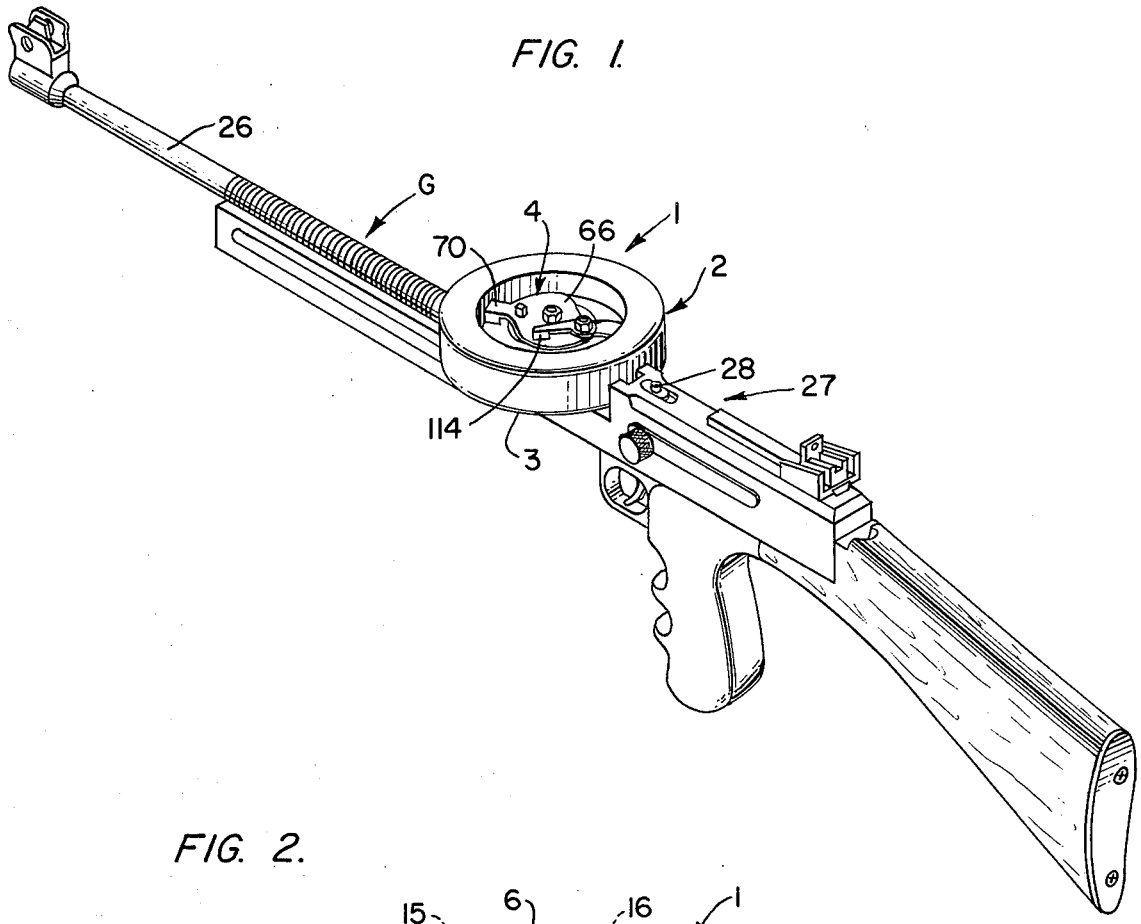
FIG. 1 is a perspective view of the present invention and illustrates the drum cartridge magazine as mounted upon a machine gun.

Referring now to the drawings, particularly FIG. 1, the present invention will be seen to comprise a cartridge drum magazine generally designated 1 adapted to be used in association with any suitable tye of automatic or machine gun such as the example as illustrated in this figure. The details of the specific construction of the various components forming the drum magazine 1 will be found to be illustrated in the remaining figures of the drawings. The principal components of the magazine include a cover 2, magazine base 3 and drive assembly 4 all of which are shown in the assembled condition in FIG. 3 of the drawings.

The cover 2 serves as a means for storing, in a vertically aligned position, a plurality of adjacent columns of cartridges C. The cover 2 includes a top wall 5 from which depend on outside wall 6 and inside wall 7 disposed in parallel spaced apart relationship to define a cartridge storage cavity 8 therebetween. The distal portion of the inside wall 7 includes a short inturned flange 9 for purposes which will become obvious hereinafter. The supply of cartridges C are maintained in a plurality of vertically aligned columns by means of an outer cartridge alignment ring 10 affixed to the interior of the cover outside wall 6 and a concentrically disposed inner cartridge alignment ring 11 affixed to the inner periphery of the cover inside wall 7. The two alignment rings 10 and 11 are provided respectively with inwardly directed ribs 12 and 13, a plurality of which extend inwardly throughout the entire circumference of the two rings, it being apparent that the spacing between each pair of adjacent ribs 12 and 13 is selected to properly contain, in a close sliding manner, the base or rim of a cartridge C and the nose thereof, respectively.

Figure 3:
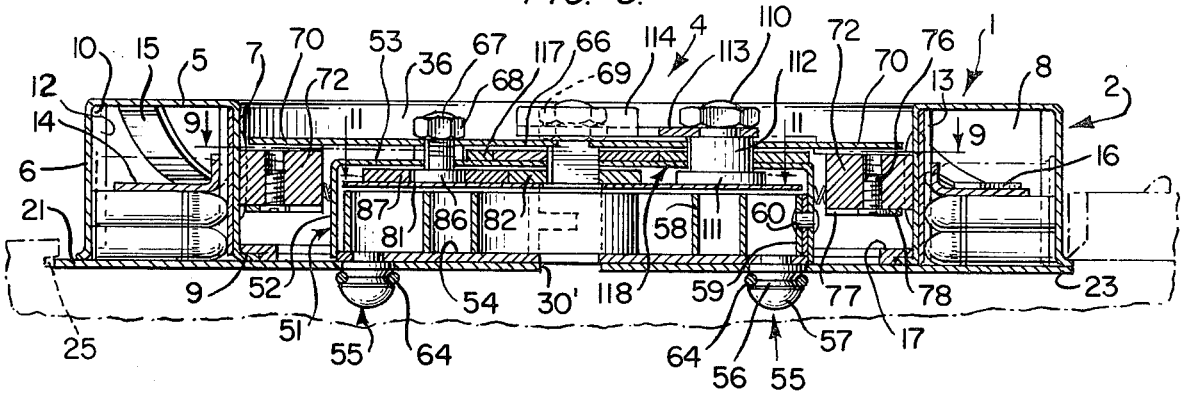
FIG. 3 is an enlarged vertical sectional view taken along the line 3—3 of FIG. 2.
Figure 5:
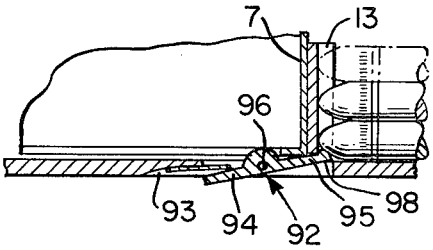
FIG. 5 is a fragmentary vertical sectional view taken along the line 5—5 of FIG. 4.

Located adjacent the interior of the cover wall top 5 is a follower ring 14 loosely fitting between the confines of the inwardly directed juxtaposed ribs 12 and 13 and which includes a plurality of spring leaves 15 normally tending to urge the follower ring downwardly as viewed in FIG. 3, away from the top wall 5 of the cartridge cover 2 so that regardless of the number of layers of cartridges C remaining in the drum magazine at any time, the entire supply of cartridges will be forced downwardly towards the bottom area of the cover 2 in a positive manner. The spring elements 15 may be of any suitable type and may be attached at one end as at 16 to the upper surface of the follower ring 14 or quite obviously may be alternatively connected at the opposite end to the undersurface of the cover top wall 5 so that in any case the follower ring 14 may be removed if necessary for servicing.

Figure 2:
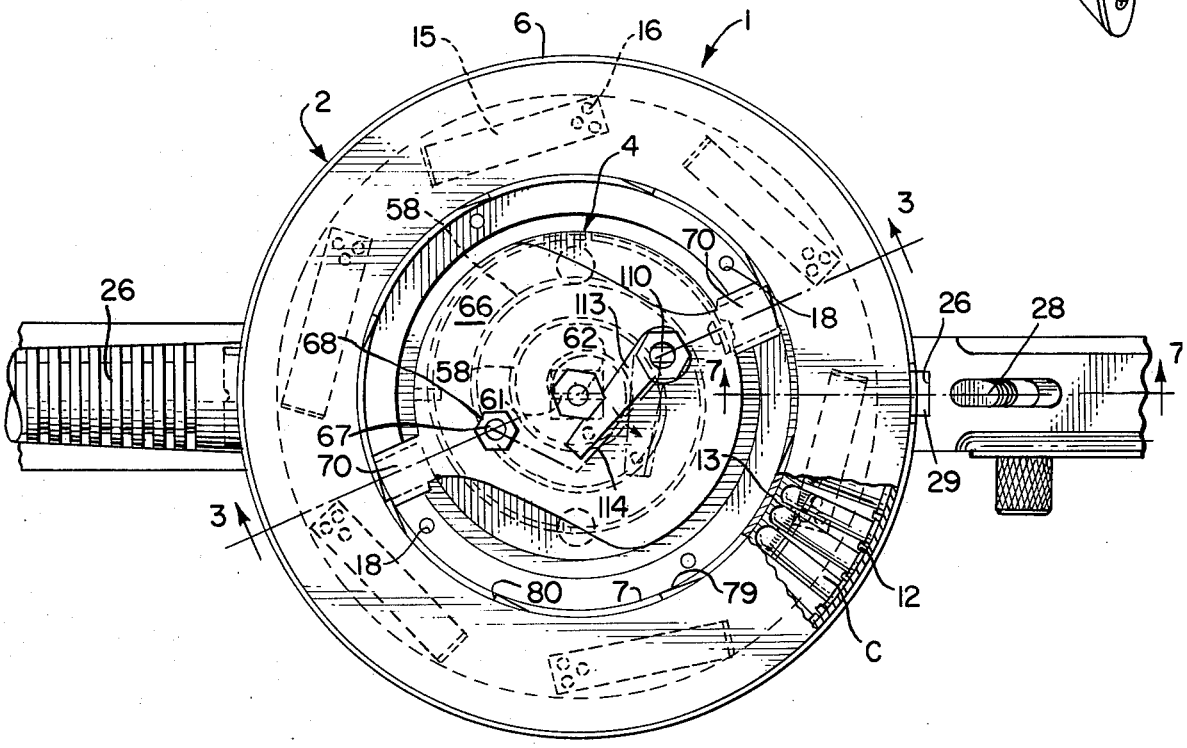
FIG. 2 is an enlarged top plan view, partly in section, of the cartridge magazine of the present invention.

Underlying the entire expanse of the cartridge storage cover 2 is a magazine base 3 comprising a circular plate having a diameter no less than the outside diameter of the cover outside wall 6. Means are provided for readily securing the base 3 to the cover 2 while allowing for relative rotary displacement therebetween. This fastening means comprises an assembly ring 17, shown most clearly in FIGS. 2 and 3, having an outside diameter substantially equal to the inside diameter of the cartridge cover inside wall 7 and which is adapted to overlie the cover flange 9 and to extend inwardly a substantial distance therefrom. A plurality of holes 18 are formed through the assembly ring 17 which holes are aligned with mating holes 19 formed in the magazine base plate 3 so that suitable fastener elements such as machine screws 20 may be inserted through the overlying assembly ring 17 and base 3 to securely anchor the cartridge cover 2 to the base 3 by means of the cover flange 9 sandwiched therebetween. To permit the desired relative rotary movement between the cover and base plate, the ring 17 is preferably stepped or recessed as shown in FIG. 3 with the screws 20 of course passing through only that portion not overlying the flange 9.

Means are provided for rigidly securing the drum magazine 1 to its associated machine gun G so as to provide for accurate alignment and retention of the magazine during subsequent use thereof. The magazine base 3 includes a flange 21 extending forwardly beyond the plane of the vertically disposed cover outside wall 6 and which is provided with a suitable detent 22 as shown most clearly in FIG. 4 of the drawings. The diametrically opposed area of the magazine base 3 is formed with a rearwardly projecting lip 23 which cooperates with the flange 21 to retain the drum magazine in a fixed plane with the bottom surface of the base 3 flush with the plane surface 24 of the gun receiver.

Any suitable means may be provided in the construction of the machine gun G to cooperate with the aforedescribed flange and lip such as the notch 25 provided in the top surface of the barrel 26 in the area immediately adjacent the receiver surface 24 which notch 25 serves as an undercut area adapted to receive the drum magazine flange 21 and to prevent lateral displacement thereof by means of a suitable projection (not shown) disposed within the notch 25 and adapted to engage the detent 22 of the flange 21. The rear area of the magazine may thence be secured by subsequently lowering the magazine within the confines of a recess 26 formed in the top of the receiver 27 immediately adjacent the receiver surface 24. When the bottom surface of the magazine base 3 is flush with the receiver surface 24 the magazine is vertically locked in place at the rear thereof by means of a suitable spring-urged slide release 28 mounted within the receiver 27 and including a forwardly extending tongue 29 adapted to overlie the magazine lip 23.

Figure 8:
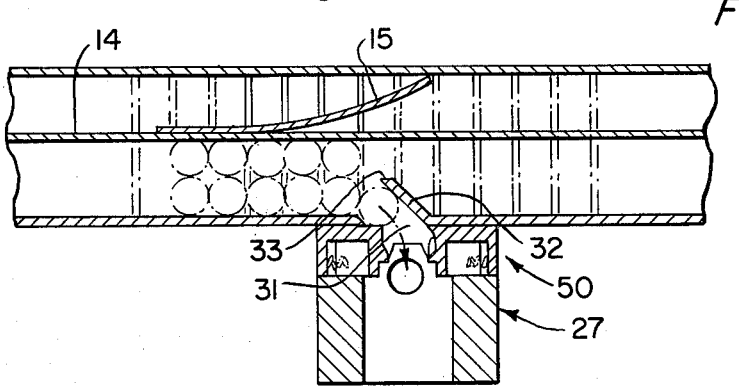
FIG. 8 is a rear vertical sectional view taken along the line 8—8 of FIG. 7.

Additional more positive means are provided for accurately aligning the magazine base 3 and precluding any lateral displacement thereof for reasons which will be found to be necessary hereinafter. This means comprises a fixed post 30 extending upwardly from the receiver surface 24 a short distance and which forms a close mating fit within a correspondingly-shaped aperture 30' provided in the magazine base 3. With the exception of one area the upper surface of the magazine base 3 presents a smooth continuous uninterrupted surface beneath the area of the cartridge storage cavity 8. At the rear of the magazine adjacent the lip 23 an opening designated as a cartridge exit 31 is provided having a longitudinal or major dimension extending a direction radially with respect to the plate aperture 30' and which is of a length no less than the overall length of a cartridge C. As shown in the bottom plan view of FIG. 4 and the forward looking vertical sectional view of FIG. 8, a strip/feed lip 32 extends from one side of the exit opening 31 in an inclined direction upwardly into the confines of the cartridge storage cavity 8 and terminates in a tip or distal portion 33 which is beveled to provide a horizontal surface disposed in a plane no higher than the top surface of the bottommost layer of cartridges C resting upon the upper surface of the drum magazine base 3. From the longitudinal side of the exit opening 31 opposite the tongue 32 is attached a horizontally and inwardly extending feed lip 34 projecting into the area of the exit 31 but a short distance. The rear edges of both the tongue 32 and lip 34 are spaced forwardly from the rear edge of the exit 31, a distance slighter greater than the thickness of the cartridge rims to provide a cartridge rim slot 35. The process of loading the cover cavity 8 with cartridges is quite simple. One merely inverts the united cover and base and while rotating the cover, sequentially inserts cartridges through the exit 31.

An understanding of the sequence of movement of the cartridges during operation of the subject drum magazine will be apparent following a description of the remaining principal components of the magazine, namely the drive assembly 4.

FIGS. 2, 3, 9, 10, 11, and 12 disclose various components comprising the drive assembly 4 which is adapted to be removably installed within the confines of the recess 36 bounded by the magazine cover inside wall 7 and magazine base 3 as illustrated in FIGS. 1 and 3 of the drawings. Broadly stated, the purpose of drive assembly 4 is to provide spring-actuated means for causing the rotation of the cartridge cover 2 during operation of the machine gun G in order to sequentially deliver cartridges C as contained in the bottommost layer of cartridges within the cover 2 to the area of the cartridge exit 31 which it will be understood is disposed above a suitable feed block 50 associated with the receiver 27 of the machine gun. It will thus follow that since the magazine base 3 is fixed with respect to the machine gun the drive assembly 4 must therefore in turn be likewise fixedly mounted with respect to the base 3 and be provided with motion transmitting means acting upon the rotatably mounted cartridge storage area as defined by the cover 2.

Drive assembly 4 includes a circular cover or housing generally designated 51 and which includes a peripheral or side wall 52 and a top wall 53 as shown most clearly in FIG. 3 of the drawings. A circular base plate 54 encloses the bottom of the housing 51 and is provided with a pair of downwardly extending lugs 55–55 which preferably comprise circular elements each having a peripheral groove 56 with a diameter less than the maximum diameter of the head 57 of the lugs for reasons which will be apparent hereinafter. Disposed within the confines of the housing 51 is a spiral spring 58 having the distal portion 59 of its outermost convolution suitably affixed to the side wall 52 of the housing 51 such as by means of the rivet 60 as illustrated in FIG. 3 while the distal portion 61 of the innermost convolution of the spring is affixed by any suitable means to a vertical spindle 62 which is anchored in turn to the center portion of the drive assembly base plate 54. The spindle 62 projects upwardly substantial distance above the housing top wall 53 at which point a threaded area is provided.

From the foregoing it will be appreciated that if the drive assembly base plate 54 is suitably secured with respect to the magazine base 3 and the drive spring 58 is in the tensed condition, the drive assembly housing 51 will be constantly urged to describe a rotating motion about the vertical spindle 62.

The previously described lugs 55—55 integral with the drive assembly base plate 54 are adapted to cooperate with a pair of holes 63 formed in the magazine base 3. These holes 63 are of a diameter just large enough to permit passage of the lug heads 57 therethrough. When the drive assembly 4 is attached as shown in FIG. 3 of the drawings it will be understood that the grooves 56 of the lugs 55 are disposed immediately adjacent the undersurface of the magazine base 3 and when in this position are engaged by the spring sections 64—64 of a pair of snap spring retainers 65—65. These snap spring retainers may be carried upon the undersurface of the magazine base 3 by means of the same fastener elements 20 as used to secure the assembly ring 17 serving to slidably interlock the base 3 and cover 2 and it will be apparent that each pair of spring sections 64—64 are constructed so as normally to be spring urged in a direction towards one another such that when the heads 57 of the drive assembly lugs are pushed through the magazine base 3 and engage the two pairs of juxtaposed spring sections 64, these spring sections will be biased outwardly until passage of the maximum diameter of the heads 57 occurs at which time the spring sections will snap inwardly to engage the inner periphery of the lug grooves 57 to securely retain the drive assembly in the use position of FIG. 3.

The actual transmission of rotary motion from the force of the coiled drive spring 58 is achieved by means of a windup plate 66 having a central aperture adapted to rotate freely about the upper portion of the spindle 62. Relative arcuate displacement between the windup plate 66 and housing 51 is precluded by means of a bolt 67 radially located wth respect to the spindle 62 and which extends from within the confines of the housing 51 through the top wall 53 thereof and through a suitable aperture in the windup plate 66. The plane of the plate 66 is spaced above the surface of the housing top wall 53 and is retained in position by means of the nut 68 on the bolt 67 as well as the nut 69 affixed to the top of the spindle 62.

Radially extending from the periphery of the main body of the windup plate 66 are a pair of diametrically opposed drive arms 70—70 each of which terminates in a channel 71 having its outermost opening disposed immediately adjacent the inside wall 7 of the drum magazine cover 2. Within the confines of each channel 71 is a pawl 72 having parallel top, bottom and side walls providing a close sliding fit within the channel and including a beveled or inclined exterior face 73, the outermost edge of which defines a sharp shoulder 74 which comprises the outermost extent of the pawl 72. Each pawl is normally constantly urged outwardly in a radial direction by means of a suitable spring 75 which bears in turn against the outer periphery of the housing sidewall 52 so that when the drive assembly 4 is in the installed position such as shown in FIG. 3 it will be apparent that the pawl shoulder 74 will be constantly urged into engagement with the cover inside wall 7. To preclude separation of the pawl 72 from the remainder of the sub-assembly when the drive assembly 4 is removed from within the recess 36 of the cover 2, a stop screw 76 is attached through the bottom of the pawl 72 with its head disposed in the confines of a slot 77 formed in the bottom wall 78 of each drive arm 70. Quite obviously the slot 77 must terminate short of the outermost point of the bottom wall 78 to thereby limit the outward radial displacement of the pawl 72 by the spring 75 when the drive assembly is removed from the remainder of the drum magazine.

Figure 9:
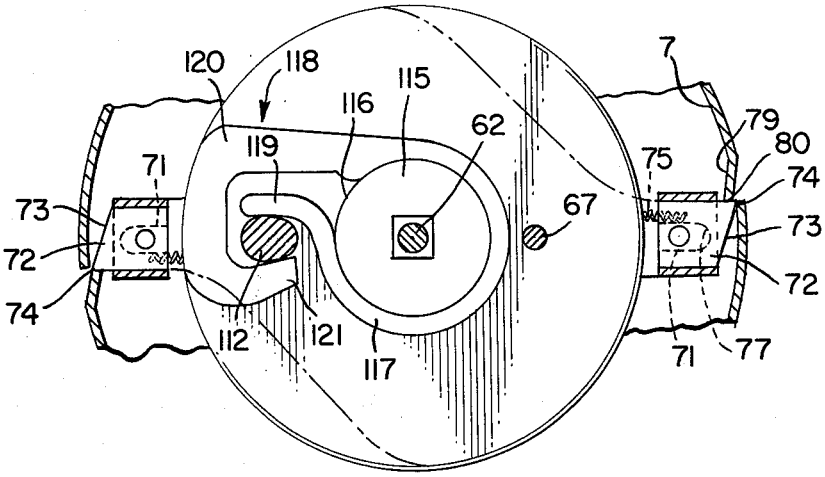
FIG. 9 is a horizontal sectional view taken along the line 9—9 of FIG. 3.

Cooperating with the shoulders 74 of the two pawls 72 are a plurality of circumferentially spaced offset stops 79 projecting inwardly from the inner periphery of the cover inside wall 7 to form a similar number of nose portions 80 normally disposed within the path of the pawl shoulder 74 as shown most clearly in FIGS. 3 and 9 of the drawings. With the foregoing described structure in mind it will now be readily appreciated that when an operator places the thumb and forefinger respectively upon the two drive arms 70—70 of the windup plate 66 and applies a twisting or rotary clockwise motion thereto, that the windup plate 66 and drive assembly housing 51 will be concurrently arcuately displaced in a manner designed to tighten or wind up the drive spring 58 contained within the housing 51. Each time the twisting motion as applied by the operator is released the tension of the thus wound spring 58 will cause a slight counterclockwise rotation of the housing and windup plate for a short distance until the two pawl shoulders 74 engage and abut the nose 80 of the closest offset stop 79 formed in the fixed inside wall 7 of the magazine cover 2.

Figure 11:
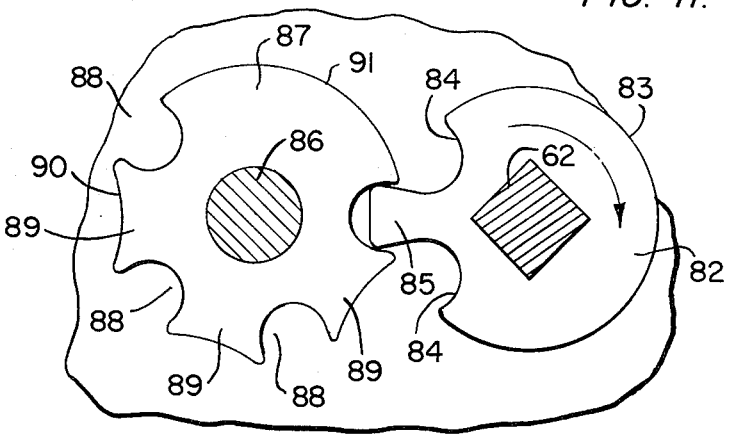
FIG. 11 is a fragmentary enlarged view, partly in section, taken along the line 11—11 of FIG. 3.
Figure 12:
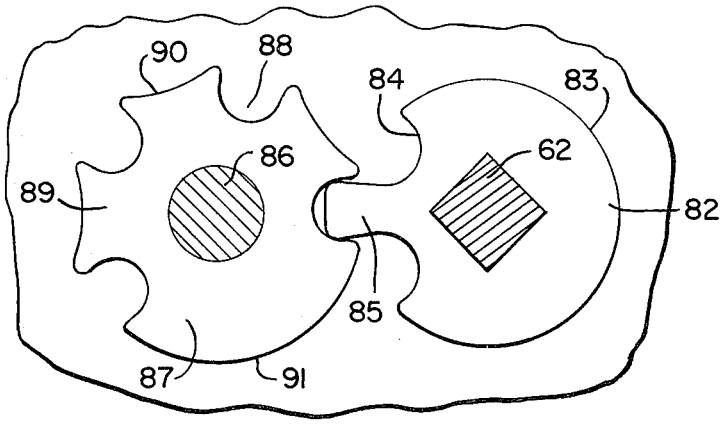
FIG. 12 is a view similar to FIG. 11 and illustrates the overwind prevention mechanism of FIG. 11 as it appears just after beginning the windup operation.

Means are included to prevent overwinding of the drive spring 58. This means therefore not only precludes damge to the spring should it be overwound but also assures a more constant tension as delivered by the spring after successive winding thereof. This overwind prevention means includes a Geneva gear or stop arrangement as illustrated in FIGS. 3, 11 and 12 of the drawings. Separating this structure from the drive spring 58 therebeneath is a thin flat partition disc 81 shown in FIG. 3. Disposed immediately above the upper surface of the partition disc 81 is a fixed disc gear 82 mounted stationary with respect to the fixed spindle 62 and which includes a semi-circular arcuate periphery 83 describing the majority of a circle and communicating with a pair of symmetrically disposed relief areas 84 encompassing therebetween an outwardly extending or radially projecting tongue actuator 85 a portion of which projects radially outwardly a greater distance than the arcuate peripheral surface 83 of the gear 82. Slidably journaled about the circular head 86 of the fixed bolt 67 is the mating component of the Geneva overwind prevention mechanism which actually operates as a planetary gear 87 and includes a plurality of equi-spaced notches 88. Each adjacent pair of the notches encompasses therebetween a nose portion 89 having a concave arcuate slide surface 90 the curvature of which mates with and is designed to be juxtaposed the arcuate surface 83 of the disc gear 82 during operation of the windup phase of the drive assembly 4.

The manner of winding up the spring 58 of the drive assembly has been previously described and with this in mind, together with the illustration of FIGS. 11 and 12, the operation of the overwind prevention mechanism will be readily apparent. It will be realized that when the windup plate 66 is moved in a clockwise direction to tighten the drive spring 58, the structure shown in FIGS. 11 and 12 will likewise move in a clockwise direction about the center point defined by the fixed vertical spindle 62 and since the disc gear 82 is likewise fixed it will be seen that the tongue 85 will successively engage each of the plurality of notches 88 as the movable gear 87 describes a planetary motion about the fixed disc gear 82. FIG. 12 of the drawings illustrates the two components as they will appear during the beginning phase of the windup operation such that following additional displacement of the bolt head 86 in a clockwise direction about the spindle 62 the gear 87 will likewise be rotated by means of the tongue actuator 85 and the next adjacent arcuate slide surface 90 as it slides about the arcuate periphery 83 of the fixed gear 82 until this slide surface 90 returns to about the 8 o'clock position at which time the tongue actuator 85 will be engulfed by the next adjacent notch 88 to begin an additional revolution of the planetary gear 87 in a clockwise direction. Continued winding of the plate 66 will cause a repetition of this operation of the Geneva type gear arrangement until three revolutions have been made of the windup plate 66 at which point the structure will appear as in FIG. 11 of the drawings. A slight additional clockwise rotation of the windup mechanism will cause the arcuate periphery 91 of the planetary gear 87 to strike the juncture between the juxtaposed relief area 84 and peripheral surface 83 of the fixed disc gear 82 thereby halting any further movement of the windup mechanism as the two gears thus abut one another. During subsequent operation of the machine gun and the natural discharge of the cartridges C through the exit 31 of the drum magazine as caused by the spring drive offered by the drive assembly 4, the inherent unwinding of the drive spring 58 and counter clockwise movement of the drive assembly will cause a reverse motion of the above described Geneva gear components until the drive spring 58 no longer contains sufficient force to rotate the cover 2 and/or the mechanism passes the position as shown in FIG. 12.

From the description of the instant invention as now related it will be apreciated that when the drum magazine is in the position of operation as shown in its mounted relationship upon the gun as in FIG. 3, whenever the drive assembly 4 is in a ready condition, that is the drive spring 58 is under tension, the drive arms 70 and their related pawls 72 will maintain a constant force against the cartridge cover 2 tending to urge the cover and the contained cartridges C in a counter clockwise direction. It will thus be apparent that means must be provided to preclude the undesirable ejection of cartridges through the exit 31 of the magazine base 3 whenever the entire drum magazine 1 is removed from the machine gun G. To provide the foregoing, it is necessary to either lock the windup plate 66 with respect to the spindle 62 or to immobilize the cartridge cover 2 with respect to the balance of the drum magazine.

Figure 6:
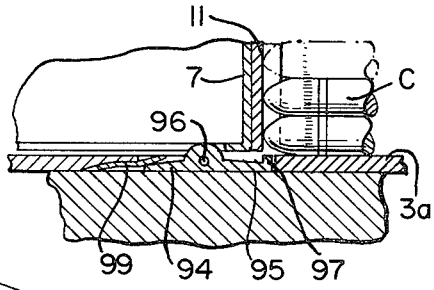
FIG. 6 is a partial vertical sectional view of the structure of FIG. 5 and illustrates this area of the drum magazine as it appears when mounted upon the machine gun.
Figure 4:
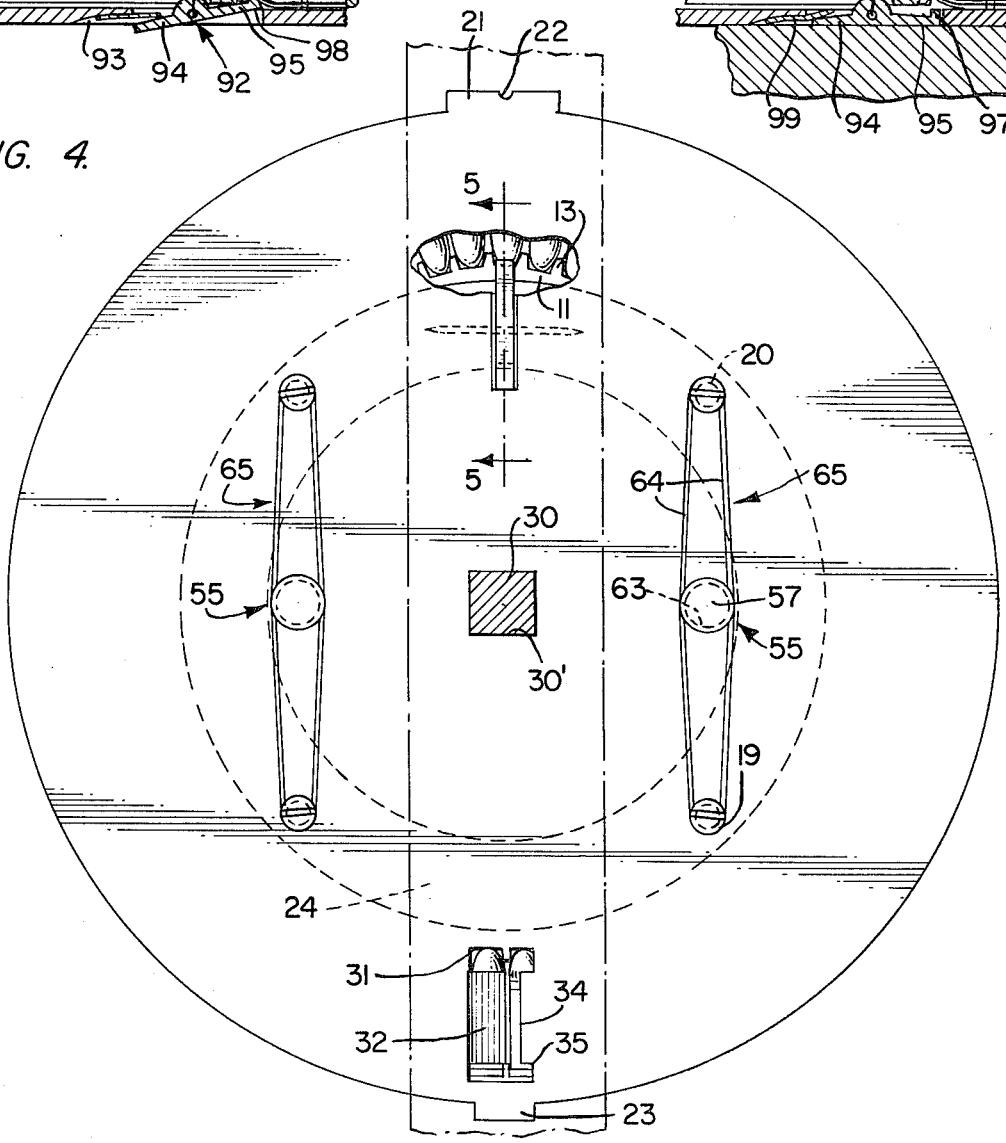
FIG. 4 is a bottom plan view, partly in section, of the cartridge magazine of the present invention.
Figure 7:
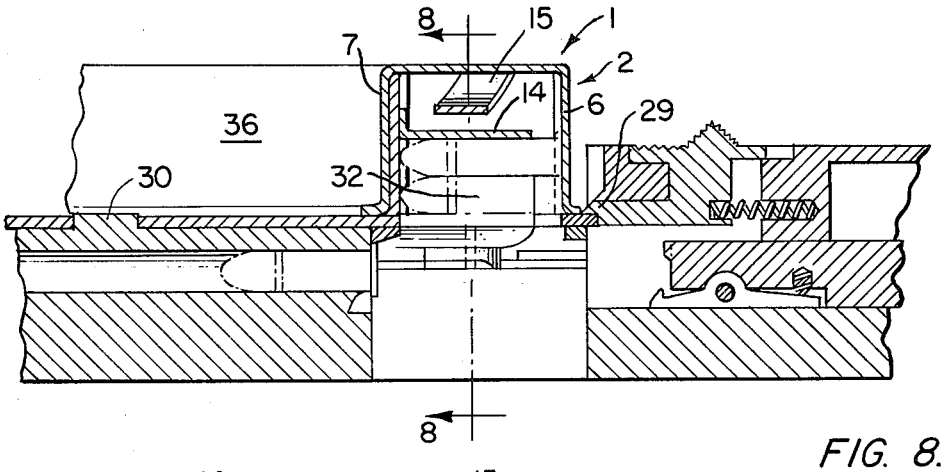
FIG. 7 is a fragmentary vertical sectional view of the rear portion of the magazine as it appears when mounted upon a gun.

The magazine base 3 is provided with a lever stop generally designated 92 which is disposed within the confines of a cutout 93 and includes a unitary member having an inner arm 94 and outer arm 95 mounted for vertical displacement about the pivot pin 96. The distal portion of the outer arm 95 will be seen to include an upstanding stop projection 97 which is located in a vertical plane passing within the confines of the cartridge storage cavity 8 between a pair of spaced apart ribs 13. When in the mounted position as shown in FIG. 6 the undersurface 98 of the lever stop 92 is disposed flush with the undersurface of the magazine base 3 and the stop projection 97 is thus located no higher than the plane of the upper surface 3a of the magazine base 3. Suitable spring means such as the leaf spring 99 is attached to the base 3 with its free end bearing upon the upper portion of the lever stop inner arm 94 such that when the drum magazine 1 is removed from the machine gun G the spring 99 immediately urges the inner arm 94 downwardly about the pivot pin 96 as the stop projection 97 on the outer arm 95 is moved upwardly to the position as shown in FIG. 4 of the drawings. In this position the stop projection 97 is disposed within the area between two adjacent ribs 13 of the inner cartridge alignment ring 11 within the cover 2 and thereby serves as a fixed stop element to preclude any lateral or arcuate movement of the cartridges and/or cover.

An important advantage of the drum magazine of the present invention is the ability to remove the drive assembly 4 in its entirety from the remainder of the drum magazine 1 at any time whether or not the magazine is mounted upon the machine gun G and regardless of the state of the tension of the drive spring 58 or the number of cartridges C contained within the cover 2. To achieve the foregoing it is necessry to immobolize the windup plate 66 with respect to the housing 51 containing the drive spring 58. Structure for accomplishing this operation is shown most clearly in FIGS. 3, 9 and 10 of the drawings. Extending through the top wall 53 of the housing 51 is a bolt element 110 having an enlarged head 111 located within the confines of the housing 51 and communicating with an adjacent cam section 112 passing through the housing topwall 53. Suitably anchored to the upper portion of the bolt element 110 is a brake lever 113 disposed above the upper surface of the windup plate 66 and having a suitable brake handle 114 at its distal portion. Affixed to the spindle 62 above the top surface of the housing topwall 53 is a brake washer 115 which is locked against rotary displacement with respect to the spindle and base plate 54 of the drive assembly and which is provided with a circular periphery 116. Surrounding a significant portion of the washer periphery 116 is the loop 117 of a brake plate generally designated 118. The loop 117 terminates on the one hand with a free arm 119 disposed against one lateral portion of the cam section 112 and on the other hand by a connecting arm 120 having a hook 121 engaging a diametrically opposed lateral surface of the cam section 112. The configuration of the free arm 119 and hook 121 is selected so that these two elements at all times maintain at least a slight frictional engagement with the cam section 112 and when the cam section is in the "off" position as shown in FIG. 9 it will be understood that the inner periphery of the loop 117 loosely engages the peripheral surface 116 of the brake washer 115 so that the windup plate 66 which carries the cam section 112 may move in a rotary manner about the axis of the spindle 62.

Figure 10:
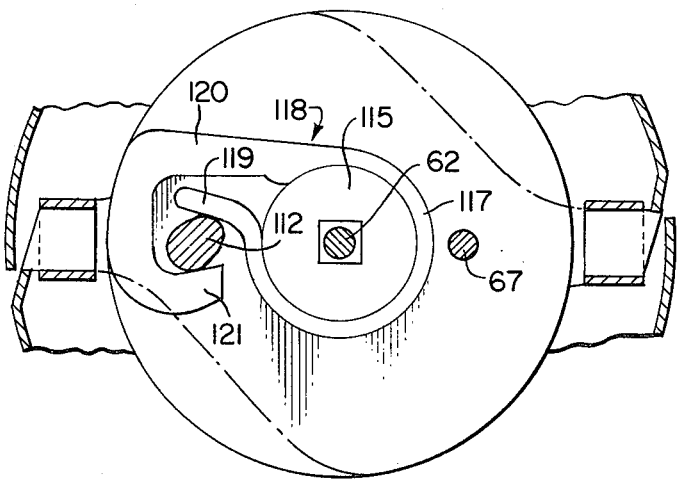
FIG. 10 is a horizontal sectional view of the spring drive mechanism of FIG. 9 and illustrates the brake assembly in the applied position.

If it is desired to remove the drive assembly 4 from the balance of the drum magazine 1, the normal tendency of the drive spring 58 to rotate the windup plate 66 may be immobilized merely by applying finger pressure to the brake handle 114 to pivot the brake lever 113 about the bolt element 110 thereby arcuately displacing its cam section 112 from the position of FIG. 9 to that shown in FIG. 10 of the drawings, thereby urging the free arm 119 of the brake plate in a direction away from the hook element 121 thereof which action applies a tightening grip between the inner periphery of loop 117 and outer periphery of the brake washer 115 to temporarily lock the washer 115 to the brake plate 118. In the thus described condition the drive assembly 4 may be readily removed from the remainder of the drum magazine whether or not the magazine is attached to the machine gun, merely by applying finger pressure to the heads 57—57 of the lugs 55—55 at which time the drive assembly will pop out from within the confines of the cover recess 50. From the foregoing it will be appreciated that unique means are provided to insure the safe removal of the drive assembly from the balance of the magazine regardless of the condition of the spring tension contained therein.

We claim:

1. A drum cartridge magazine for a machine gun having a receiver mounting surface, including, a base plate adapted to overlie the gun receiver surface and having a cartridge exit therethrough for delivering cartridges to the gun receiver, means on said base plate for fixed attachment to said receiver mounting surface, a ring-shaped cover defining a storage cavity adapted to contain a plurality of cartridges overlying said base plate, means connecting said cover to said plate while permitting relative angular displacement therebetween, alignment means within said cover cavity maintaining cartridges therein in a plurality of adjacent vertically disposed columns, a drive assembly centrally disposed within the confines of said cover, means removably attaching said drive assembly to said base plate, said drive assembly including a base member fixedly attached relative said magazine base plate, a rotatable drive arm on said drive assembly provided with a distal portion engageable with said cover to angularly displace said cover relative to said magazine base plate and drive assembly base member and to sequentially advance cartridges therein to said plate exit, spring means within said drive assembly having opposite ends respectively fixed relative said drive assembly base member and drive arm to rotate said drive arm when said spring means is energized, and said drive assembly including brake means operable to immobilize said drive arm against rotary displacement when said spring means is energized whereby, said drive assembly may be removed from said magazine base plate without de-energizing said spring means when said brake means is operated.

2. A drum cartridge magazine according to claim 1 including, a diametrically opposed flange and lip radially extending from said magazine base plate and engageable with a pair of mating components on said gun adjacent said receiver surface and one of said components is releasable to permit selective attachment and removal of said drum magazine to and from said gun, respectively.

3. A drum cartridge magazine according to claim 1 wherein, said base plate is provided with a medially disposed aperture engageable with an upstanding post on said receiver surface having a configuration mating with that of said aperture.

4. A drum cartridge magazine according to claim 1 including, a strip/feed tongue adjacent base plate exit, said tongue extending in an upwardly inclined direction over said exit and provided with a distal tip disposed at a height above said base plate substantially equal to the diameter of one said cartridge.

5. A drum cartridge magazine according to claim 1 wherein, said cover includes a top wall having depending therefrom cylindrical inside and outside walls with said cavity therebetween, a flange extending radially inwardly from the bottom of said inside wall, said cover connecting means including an assembly ring overlying said flange and means fastening said ring to said base plate in a fixed manner permitting of horizonal sliding movement of said flange as sandwiched between said ring and base plate.

6. A drum cartridge magazine according to claim 5 wherein, said assembly ring is stepped in cross-section with its thickest portion tightly engaging said base plate and its thinner portion slidably overlying said cover inside wall flange.

7. A drum cartridge magazine according to claim 1 wherein, said cover includes a top wall having depending therefrom cylindrical inside and outside walls with said cavity therebetween, said cartridge alignment means including a plurality of radially extending ribs oppositely disposed on said cover inside and outside walls, whereby, adjacent said ribs on said outside and inside walls are spaced to closely engage in a sliding manner the rim and nose, respectively, of cartridges disposed therebetween.

8. A drum cartridge magazine according to claim 7 including, an alignment ring attached to and within each said inside and outside cover wall and said ribs are carried by said rings.

9. A drum cartridge magazine according to claim 1 including, stop means on said magazine base plate automatically operable upon removal of said base plate from said receiver surface to preclude angular displacement between said cover and base plate.

10. A drum cartridge magazine according to claim 9 wherein, said stop means comprises a lever pivotally attached to said base plate and having an inner arm and outer arm, spring means urging said inner arm downwardly and said outer arm upwardly when said base plate is removed from said receiver surface and a projection on said outer arm engageable with said cartridge alignment means when said outer arm is springurged upwardwardly.

11. A drum cartridge magazine according to claim 1 including, a ring-shaped follower within said cover disposed above the uppermost cartridges therein, and spring means normally urging said follower downwardly to bias all cartridges within said cover toward said base plate.

12. A drum cartridge magazine according to claim 11 wherein, said spring means within said cover comprises a plurality of leaf springs each having a lower portion attached to the upper surface of said follower and said leaf springs normally extend upwardly from said follower.

13. A drum cartridge magazine according to claim 1 wherein said cover is provided with a plurality of offset stops projecting radially inwardly toward said drive assembly and engageable by said drive arm distal portion.

14. A drum cartridge magazine according to claim 13 including, a pawl carried by said drive arm distal portion and spring means urging said pawl toward said cover and offset stops.

15. A drum cartridge magazine according to claim 14 including, a pair of said drive arms diametrically opposed to one another and each provided with one said pawl.

16. A drum cartridge magazine according to claim 1 wherein, said drive assembly base member is provided with said removable attaching means thereon, a vertical spindle axially fixed to said base member, a housing over said base member and rotatable about said spindle, a windup plate overlying said housing and rotatable about said spindle with said drive arm radially extending therefrom, and said spring means is mounted within said housing.

17. A drum cartridge magazine according to claim 16 wherein, said spring means comprises a spiral spring having one end anchored to said spindle and its other end secured to said housing.

18. A drum cartridge magazine according to claim 16 wherein, said brake means includes bolt means securing said windup plate to said housing, said bolt means including a bolt element having a cam thereon, a brake plate encircling said spindle and provided with a pair of arms engaging opposite sides of said cam, and a brake lever atop said windup plate keyed to said bolt element whereby, arcuate displacement of said lever actuates said cam to displace said brake plate arms and secure said brake plate and windup plate against rotary movement with respect to said spindle.

19. A drum cartridge magazine according to claim 18 including, a circular washer anchored to said spindle, and said brake plate encircling said spindle provided with a loop portion substantially surrounding the periphery of said washer.

20. A drum cartridge magazine for a machine gun having a receiver mounting surface, including, a base plate adapted to overlie the gun receiver surface and having a cartridge exit therethrough for delivering cartridges to the gun receiver, means on said base plate for fixed attachment to said receiver mounting surface, a ring-shaped cover defining a storage cavity adapted to contain a plurality of cartridges overlying said base plate, means connecting said cover to said plate while permitting relative angular displacement therebetwen, alignment means within said cover cavity maintaining cartridges therein in a plurality of adjacent vertically disposed columns, a drive assembly centrally disposed within the confines of said cover, means removably attaching said drive assembly to said base plate, said drive assembly including a base member fixedly attached relative said magazine base plate, a rotatable drive arm on said drive assembly provided with a distal portion engageable with said cover to angularly displace said cover relative to said magazine base plate and drive assembly base member and to sequentially advance cartridges therein to said plate exit, spring means within said drive assembly having opposite ends respectively fixed relative said drive assembly base member and drive arm to rotate said drive arm when said spring means is energized, and said drive assembly including geneva gear means restricting the rotary displacement of said drive arm relative said drive assembly base member.

21. A drum cartridbge magazine for a machine gun having a receiver mounting surface, including, a base plate adapted to overlie the gun receiver surface and having a cartridge exit therethrough for delivering cartridges to the gun receiver, a ring-shaped cover defining a storage cavity adapted to contain a plurality of cartridges overlying said base plate, means connecting said cover to said plate while permitting relative angular displacement therebetween, alignment means within said cover cavity maintaining cartridges therein in a plurality of adjacent vertically disposed columns, a drive assembly centrally disposed within the confines of said cover, means removably attaching said drive assembly to said base plate, said drive assembly including a rotatable drive arm provided with a distal portion engageable with said cover to angularly displace said cover relative to said base plate and sequentially advance cartridges therein to said plate exit, spring means within said drive assembly to rotate said drive arm, said removable attaching means including a plurality of lugs extending from the bottom of said drive assembly, said base plate provided with a plurality of holes mating with said lugs, and a snap spring retainer carried by the undersurface of said base plate adjacent each said hole and engageable with each said lug when inserted through said hole.

22. A drum cartridge magazine for a machine gun having a receiver mounting surface, including, a base plate adapted to overlie the gun receiver surface and having a cartridge exit therethrough for delivering cartridges to the gun receiver, a ring-shaped cover defining a storage cavity adapted to contain a plurality of cartridges overlying said base plate, means connecting said cover to said plate while permitting relative angular displacement therebetween, alignment means within said cover cavity maintaining cartridges therein in a plurality of adjacent vertically disposed columns, a drive assembly centrally disposed within the confines of said cover, means removably attaching said drive assembly to said base plate, said drive assembly including a rotatable drive arm provided with a distal portion engageable with said cover to angularly displace said cover relative to said base plate and sequentially advance cartridges therein to said plate exit, said drive assembly including a base member having said removable attaching means thereon, a vertical spindle axially fixed to said base member, a housing over said base member and rotatable about said spindle, a windup plate overlying said housing and rotatable about said spindle with said drive arm radially extending therefrom, spring means within said drive assembly housing to rotate said drive arm, a fixed bolt secured to said housing and radially spaced from said spindle, a geneva stop gear journalled about said bolt, a disc gear having a tongue actuator secured to said spindle, and said geneva gear includes an arcuate peripheral surface on the one hand and a plurality of equi-spaced notches on the other hand, said notches adapted to alternately engage said tongue actuator as said housing is rotated about said spindle with said geneva gear describing a planetary motion about said disc gear whereby rotation of said housing will be limited upon abutment of said arcuate peripheral surface with said fixed disc gear.

* * * * *